United States Patent [19]

Zipprath et al.

[11] Patent Number: 4,840,160

[45] Date of Patent: Jun. 20, 1989

[54] VALVE CONTROL DEVICE

[75] Inventors: Michael Zipprath, Herzogenaurach; Dieter Schmidt, Nuremberg, both of Fed. Rep. of Germany

[73] Assignee: INA Walzlager Schaeffler KG, Fed. Rep. of Germany

[21] Appl. No.: 154,802

[22] Filed: Feb. 11, 1988

[30] Foreign Application Priority Data

Feb. 14, 1987 [DE] Fed. Rep. of Germany ..... 3704743

[51] Int. Cl.[4] ..... F02M 38/00

[52] U.S. Cl. ..... 123/467; 123/506; 123/460; 137/493.3

[58] Field of Search ..... 123/467, 506, 460, 456; 137/493.3, 493.4, 493.5, 493.6, 512.2, 513.3

[56] References Cited

U.S. PATENT DOCUMENTS

| | | | |
|---|---|---|---|
| 4,524,799 | 6/1985 | Fenne | 123/467 |
| 3,965,826 | 6/1976 | Tissot | 123/467 |
| 4,437,443 | 3/1984 | Hofbauer | 123/467 |
| 4,467,767 | 8/1984 | Kampichler | 123/506 |
| 4,478,189 | 10/1984 | Fenne | 123/467 |
| 4,577,606 | 3/1980 | Bohringer | 123/467 |
| 4,628,957 | 12/1980 | Hofer | 123/467 |
| 4,648,369 | 3/1987 | Waniveinwetsch | 123/467 |
| 4,762,386 | 10/1973 | Vhaille | 123/467 |

FOREIGN PATENT DOCUMENTS

| | | | |
|---|---|---|---|
| 1289359 | 2/1969 | Fed. Rep. of Germany | 123/462 |
| 2348865 | 4/1975 | Fed. Rep. of Germany | 123/506 |
| 2107000 | 4/1983 | United Kingdom | 123/506 |

*Primary Examiner*—Carl Stuart Miller

*Attorney, Agent, or Firm*—Bierman and Muserlian

[57] ABSTRACT

A control device for a valve arranged in a fuel injection line of an internal combustion engine and closable to build up of injection pressure at an injection nozzle wherein a play adjusting element is arranged between a valve body of the valve and a drive element, characterized in that the adjusting element (14) is provided with two pistons (15, 22) guided in a housing (13), the first pistion (15) is acted upon by the drive element and the second pistion(22) acts upon the valve body, and the housing (13) accommodates between the pistons (15, 22) an oil-containing pressure chamber (23) which is sealed against the valve (1, 2) and accommodates a pressure spring (24) acting upon the pistions (15, 22).

8 Claims, 1 Drawing Sheet

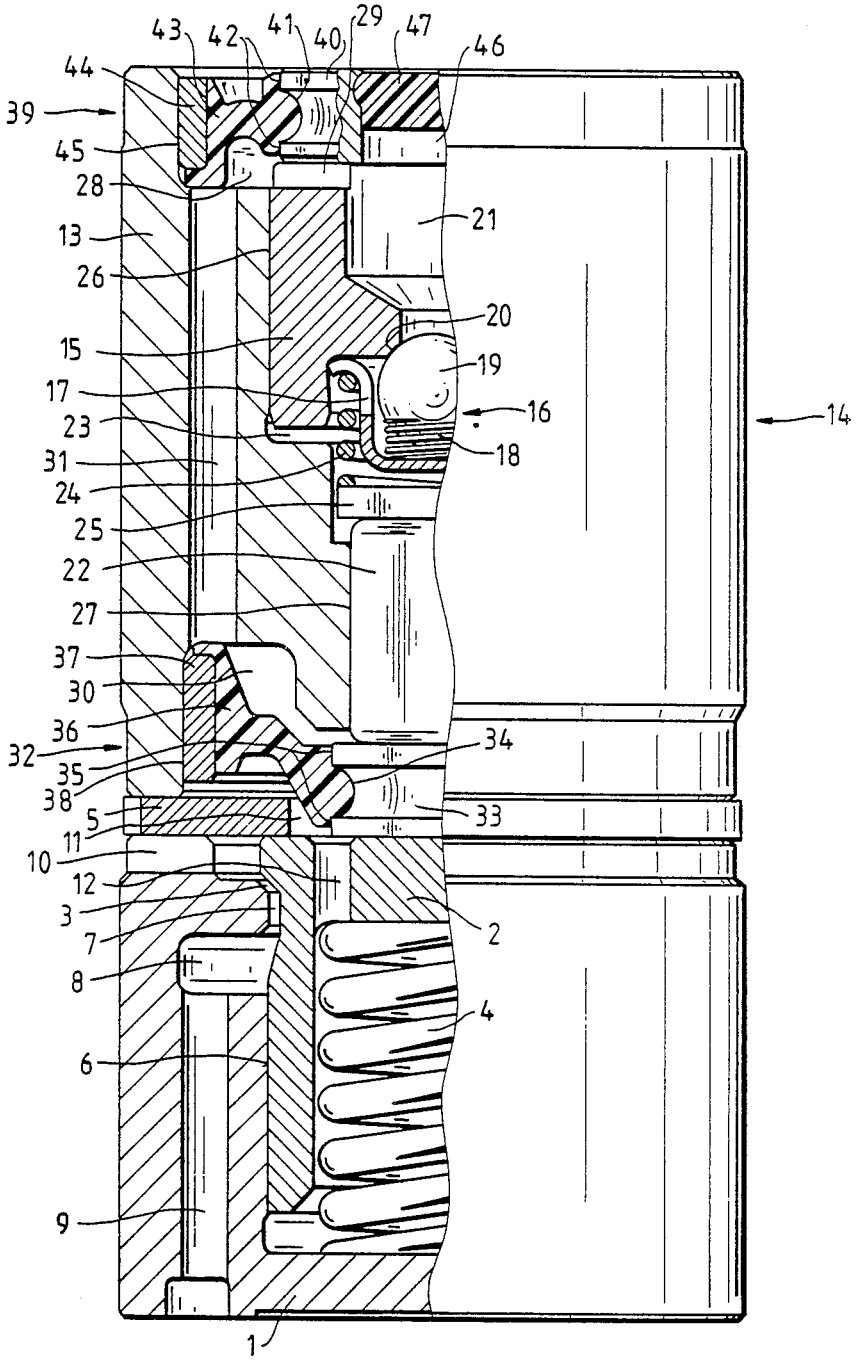
43
42
41
40
29
47
46
44
39
45
28
13
26
15
17
23
31
24
25
22
27
37
30
36
32
35
38
5
11
10
12
3
7
8
6
9
1
2
4
33
34
14
16
18
19
20
21

VALVE CONTROL DEVICE

STATE OF THE ART

Control device for a valve arranged in a fuel injection line of an internal combustion engine and closable by building up an injection pressure at an injection nozzle wherein a self-adjusting element is arranged between a valve body of the valve and a drive element are known. In such a control device, the drive element which, for example, is electronically controlled delivers a force-path impulse which closes the valve disposed in a fuel return line thereby building up a desired high injection pressure at the injection nozzle of the respective cylinder of the engine. To attain a force transfer free from play, the play adjusting element is provided between the drive element and the valve body.

OBJECTS OF THE INVENTION

It is an object of the invention to provide a control device of the above-stated kind in which the adjusting element is provided with a high rigidity and low moving masses without being filled with fuel.

This and other objects and advantages of the invention will become obvious from the following detailed description.

THE INVENTION

The novel control device of the invention for a valve arranged in a fuel injection line of an internal combustion engine and closable to build up an injection pressure at an injection nozzle wherein a play adjusting element is arranged between a valve body of the valve and a drive element, is characterized in that the adjusting element (14) is provided with two pistons (15,22) guided in a housing (13), the first piston (15) is acted upon by the drive element and the second piston (22) acts upon the valve body, and the housing (13) accommodates between the pistons (15,22) an oil-containing pressure chamber (23) which is sealed against the valve (1,2) and accommodates a pressure spring (24) acting upon pistons (15,22).

The pressure spring urges the first piston free from play against the drive element and the second piston against the valve body occupying the open position. To close the valve, the drive element presses on the first piston so that the second piston is shifted via the oil filling and acts on the valve body so that the valve closes. The oil filling guarantees a high rigidity of the drive and it is especially favorable that the oil filling of the pressure chamber can be selected independently of the fuel in accordance with the required properties with regard to viscosity and temperature behavior.

The pistons have a small mass in comparison to the housing so that the dynamic properties of the entire system are improved. By designing the diameter of both pistons in different ways, it is possible to attain a gearing up or gearing down of the stroke of the drive element.

In a preferred embodiment of the invention, the housing accommodates an oil reservoir which is in communication with the leakage gap provided in the housing between the piston and its guides, and a check valve is arranged between the oil reservoir and the pressure chamber through which oil enters the pressure chamber during a relief. This guarantees that the pressure chamber remains filed with oil despite oil losses via the leakage gap.

REFERRING NOW TO THE DRAWING

The FIGURE is a partial cross sectional view of the valve control device of the invention.

A valve body (2) is supported for displacement in a valve housing (1) and disposed between the valve body (2) and the valve housing (1) is a valve seat (3). The Figure shows the valve body (2) in its open position in which it is urged by a pressure spring (4) against a stop ring (5) whereby the valve seat (3) defines a fluid passage. The stroke of the valve body (2) is smaller than 1 mm. The valve body (2) has a cylindrical guide surface (6) with a diameter corresponding approximately to the diameter of the valve seat (3). A circumferential recess (7) is arranged in the valve body (2) between the guide surface (6) and the valve seat (3) and is in communication with an annular channel (8) of the valve housing (1). Communicating with the annular channel (8) is a bore (9) and at the side of the valve seat (3) facing away from the annular channel (8) is an outlet (10).

The bore (9) is connected to a fuel injection line which extends between an injection pump and an injection nozzle of a cylinder of an internal combustion engine and the outlet (10) leads back to the induction side of the injection pump. As long as the valve body (2) remains in its open position, no significant injection pressure prevails at the injection nozzle. When shifting the valve body (2) into its closed position, a desired high injection pressure of, for example, 1000 bar is built up at the injection nozzle. The valve body (2) includes a pressure compensating bore (12) which communicates with the inner space (11) of the stop ring (5) and fuel may be accumulated in the inner space (11).

Placed on the stop ring opposite to the valve housing (1) is a housing (13) of a compensating element (14) and a first piston (15) is guided in the housing (13). Arranged at the latter is a check valve (16) which includes a retaining cap (17) and a valve ball (19) supported by the latter via a locking spring (18). Associated to the valve ball (19) is a ball seat (20) of a cavity (21) of the first piston (15). Moreover, a second piston (22) is guided in the housing (13) and is made of solid material and is defined by a ground needle as known from needle bearings.

Disposed between the first piston (15) and the second piston (22) is an oil-containing pressure chamber (23) and a pressure spring (24) is arranged in the pressure chamber (23) and supported, on the one hand, by the first piston (15) via the edge of the retaining cap (17) and, on the other hand, by the second piston (22) via an intermediate plate (25). The diameter of the first piston (15) is greater than the diameter of the second piston (22). Arranged between the first piston (15) and the housing (13) is a leakage gap (26) and arranged between the second piston (22) and the housing (13) is a leakage gap (27). The leakage gap (26) communicates with an annular space (28) which is connected via a passage (29) with the cavity (21). The leakage gap (27) communicates with an annular space (30) which is connected by at least one bore (31) with the annular space (28). The cavity (21), the annular spaces (28,30) and the bore (31) define together the oil-containing oil reservoir.

The keep the escape of oil through the leakage gap (26,27) as low as possible, narrow fits are provided on the one hand and on the other hand, the pistons (15,22) are dimensioned as long as possible relative to the available structural space. The length of the second piston (22) is greater than the diameter thereof.

The annular space (30) is sealed against the inner space (11) by a membrane arrangement (32) which includes a plate (33) extending between the second piston (22) and the valve body (2). The plate (33) is provided at its circumference with a groove (34) of graduated circles in cross section. Vulcanized to the groove (34) at its edges (36) is an elastic ring (36) of rubber thereby attaining a comparably large contact surface beween the plate (33) and the ring (36). The elastic ring (36) is vulcanized on its outer circumference to a sleeve (37) which is disposed in press fit within a bore (38) of the housing (13.)

The annular space (28) is sealed with a similar membrane arrangement (39) against its surrounding which membrane arrangement (39) includes a plate (40) with a groove (41) semicircular in cross section. Vulcanized to the latter and its edges (42) is an elastic rubber ring (43). The outer circumference of the ring (43) is vulcanized to a sleeve (44) which is inserted in press fit within a bore (45) of the housing (13). The plate (40) is provided with a feed opening (46) for oil which is closed by a plug (47). The plate (40) bears against the first piston (15) and bearing against the side of the plate (40) facing away from the first piston (15) is the drive element which is not illustrated in detail. The elastic rings (36,43) may be made of plastic or sheet metal.

Taking the position as illustrated in the Figure, the mode of operation of the described device is as follows: The injection pump pumps fuel through the bore (9), the annular channel (8), the circumferential recess (7), the valve seat (3) and the outlet (10) while the injection nozzle is closed. The pressure spring (4) keeps the valve seat (3) open. The pressure chamber (23) and the oil reservoir are filled with oil and under the action of the pressure spring (24) which is weaker than the pressure spring (4), the first piston (15) is urged without play via the plate (40) against the drive element and the second piston (22) is urged without play via the plate (33) against the valve body (2).

By being actuated now, the drive element shifts via the plate (40) the first piston (15) which displaces the oil of the prssure chamber (23) thereby shifting the second piston (22) in accordance with the transmission. The second piston (22) presses in opposition to the force of the pressure spring (4) against the plate (33) so that the valve seat (3) closes, thereby building up the desired pressure within the annular channel (8) and thus also at the injection nozzle.

The closing force to be transmitted for the valve seat (3) via the first piston (15), the oil filling of the pressure chamber (23) and the second piston (22) is comparably low since the diameter of the valve seat (3) at one side of the annular channel (8) and the diameter of the guide surface (6) at the other side of the annular channel (8) essentially correspond to each other. As long as the valve body (2) is maintained in the closed position, oil leaks from the pressure chamber (23) via the leakage gap (26,27) into the annular spaces (28,30). Nevertheless, the closed position of the valve seat (3) is maintained.

When the drive element is switched off, the pressure spring (4) can push back the second piston (22) via the plate (33) and thus the first piston (15) with the plate (40) whereby the plate (40) remains in contact at the drive element. As soon as the valve body (2) abuts the stop ring (5), the pressure spring (24) may be further relieved thereby increasing the volume of the pressure chamber (23). Thus, an underpressure prevails in the latter relative to the oil reservoir and the valve ball (19) is thus lifted off the ball seat (20) so that oil is resupplied into the pressure chamber (23).

Various modifications of the control device of the invention may be made without departing from the spirit or scope thereof and it is to be understood that the invention is intended to be limited only as defined in the appended claims.

What we claim is:

1. A control device for a valve arranged in a fuel injection line of an internal combustion engine and closable to build up an injection pressure at an injection nozzle wherein a play adjusting element is arranged between a valve body of the valve and a drive element, characterized in that the adjusting element (14) is provided with two pistons (15,22) guided in a housing (13), the first piston (15) is acted upon by the drive element and the second piston (22) acts upon the valve body, and the housing (13) accommodates between the pistons (15,22) an oil-containing pressure chamber (23) which is fluidly isolated in relation to the valve (1,2) and accommodates a pressure spring (24) acting upon pistons (15,22).

2. A control device of claim 1 wherein the housing (13) contains an oil reservoir (28,30,31) communicating with the leakage gaps (26,27) disposed between the pistons (15,22) and their guides within the housing (13), and a check valve (16) is arranged between the oil reservoir (28,30,31) and the pressure chamber (23) through which oil enters into the pressure chamber (23) upon relief of the pressure spring (24).

3. A control device of claim 1 wherein the pressure spring (24) is weaker than a spring (4) shifting the valve body (2) into its open position.

4. A control device of claim 1 wherein the valve body (2) abuts in its open position against a stop ring (5) so that a remaining stroke is maintained for relief of the pressure spring (24).

5. A control device of claim 1 wherein the length of the second piston (22) is greater than its diameter.

6. A control device of claim 1 wherein the oil reservoir (28,30,31) is fluidly isolated in relation to the valve (1,2).

7. A control device of claim 1 wherein the oil reservoir (28,30,31) is closed at both its sides by a membrane arrangement (32,39) which includes a plate (33,40) bearing against the first and second pistons (15,22), respectively, and surrounded by an elastic ring (36,43) attached to a sleeve (37,44) disposed in press fit within the housing (13).

8. A control device of claim 1 wherein a valve ball (19) of the check valve (16) abuts on a ball seat (20) of the first piston (15).

* * * * *